United States Patent [19]

Pryor

[11] 4,197,964

[45] Apr. 15, 1980

[54] STARTER MEANS FOR A POP-UP TYPE SHEET PRODUCT DISPENSING PACKAGE HAVING A RESTRICTIVE DISPENSING ORIFICE

[75] Inventor: Rochelle Y. Pryor, Cincinnati, Ohio

[73] Assignee: The Procter & Gamble Company, Cincinnati, Ohio

[21] Appl. No.: 932,663

[22] Filed: Aug. 10, 1978

[51] Int. Cl.[2] ..... A47K 10/20

[52] U.S. Cl. ..... 221/50; 221/211

[58] Field of Search ..... 221/50, 63, 48, 211; 206/494

[56] References Cited

U.S. PATENT DOCUMENTS

| | | | |
|---|---|---|---|
| 910,756 | 1/1909 | Wheeler, Jr. | 221/50 |
| 1,381,307 | 6/1921 | Hudson | 221/48 X |

FOREIGN PATENT DOCUMENTS

| | | | |
|---|---|---|---|
| 1210491 | 10/1970 | United Kingdom | 221/211 |

*Primary Examiner*—Stanley H. Tollberg
*Attorney, Agent, or Firm*—Frost & Jacobs

[57] ABSTRACT

A starter sheet for a package of the type dispensing individual product sheets, one at a time in pop-up fashion, and alternately from discrete first and second continuous webs of product sheets. The webs are interfolded to form a stack of product sheets with the first half of the first product sheet of the first web overlying the first half of the first product sheet of the second web at the top of the stack. The package has a restrictive dispensing orifice of such size that the consumer cannot start the first product sheet of the first web through the dispensing orifice with his fingers. The starter sheet is formed into a Z-fold overlying and underlying the first half of the first product sheet of the first web and partially underlying the first half of the first product sheet of the second web. A portion of the starter sheet extends through the restrictive dispensing orifice of the package by an amount sufficient to be conveniently grasped by the fingers of the consumer.

9 Claims, 5 Drawing Figures

STARTER MEANS FOR A POP-UP TYPE SHEET PRODUCT DISPENSING PACKAGE HAVING A RESTRICTIVE DISPENSING ORIFICE

TECHNICAL FIELD

The invention relates to starter means for a pop-up type dispensing package for a sheet product, the package having a restrictive dispensing orifice and containing the product sheets in the form of first and second continuous webs of sheets so interfolded that the product sheets are dispensed alternately from each web; and more particularly to a starter sheet extending partway through the package dispensing orifice so that it may be conveniently withdrawn from the dispensing orifice to bring the topmost product sheet of the first web to its pop-up position and the topmost product sheet of the second web to or partway through the restrictive dispensing orifice.

BACKGROUND ART

The starter means of the present invention is intended to be used with a stack of product sheets of the type taught in U.S. Pat. 1,381,307 in the name of David W. Hudson, issued June 14, 1921. This reference teaches a stack of product sheets comprising first and second continuous webs of sheets interfolded to form the stack. The product sheets of each of the webs are defined by lines of perforations extending transversely of the web. The first and second webs are brought together in face-to-face relationship with the lines of perforations of the first web being located midway between the lines of perforations of the second web, and vice versa. The first and second webs are then folded to form a stack. Each web is folded both at the midpoints of its product sheets and at its lines of perforations, with the result that the product sheets of the first and second webs are, in essence, interleaved. Thus the first product sheet of the first web constitutes the topmost product sheet of the stack and both overlies and underlies the first half of the first product sheet of the second web. The first product sheet of the second web overlies the second half of the first product sheet of the first web and underlies the first half of the second product sheet of the first web. This general relationship is repeated throughout the stack of sheets and as a consequence, as the product sheets are dispensed from the stack, they will be dispensed alternately from the first and second webs of the stack.

The present invention is also intended for use with a dispensing package of the type having a restrictive dispensing orifice. As used herein and in the claims, the phrase "restrictive dispensing orifice" refers to a dispensing orifice of such size that the topmost product sheet of the stack contained within the package cannot be grasped by the fingers of the consumer through the dispensing orifice. While not intended to be so limited, for purposes of an exemplary showing, the starter means of the present invention will be described in its application to a package of the type taught in the commonly owned U.S. Letters Pat. No. 4,138,034 in the name of Robert F. McCarthy, issued Feb. 5, 1979, and in commonly owned copending design application Ser. No. 777,492, filed Mar. 11, 1977, in the names of Robert F. McCarthy and Price D. Carter and entitled DISPENSOR PACKAGE.

The choice of pop-up dispensing packages of the type taught in the above mentioned U.S. Pat. No. 4,138,034, for purposes of an exemplary showing, is made for two reasons. First of all, such packages are provided with dispensing orifices which are excellent examples of restrictive dispensing orifices to which the present application is directed. Secondly, such packages are intended to contain pre-moistened product sheets and are not intended to have their cover members removed, so that the provision of a starter means and the reliability of the pop-up type dispensing are of particular importance.

Briefly, the above mentioned U.S. Pat. No. 4,138,034 and copending application teach moisture-proof packages of pre-moistened product sheets, each package being provided with a dispensing opening so dimensioned as to enable twice the cross sectional area of a pre-moistened product sheet (i.e. two pre-moistened product sheets is tightly gathered form) to pass therethrough without such undue friction as would cause the product sheets to jam, tear or separate before the next succeeding product sheet is presented for subsequent removal. The succeeding product sheet not only is presented for subsequent removal, but also serves in the meantime as a plug for the dispensing opening, minimizing evaporation of the volatile composition with which the product sheets have been pre-moistened and preventing contamination of the remaining product sheets within the package. No additional closure or lid is required to be closed by the consumer to prevent dry-out or contamination.

The broad concept of the provision of a starter sheet is not, in and of itself, new. U.S. Pat. No. 2,761,676, in the names of Reinhardt N. Sabee, Harold V. Rutkus and Charles J. Greiner, issued Sept. 4, 1956, teaches the provision of a starter sheet for a pop-up type dispensing package for tissue. The package is provided with a long, narrow dispensing slot. The starter sheet is configured to provide an edge at the position of the dispensing slot which may be readily grasped by the consumer. Commonly owned copending application Ser. No. 780,697 in the names of Kent R. Wahl and Robert Harm, entitled STARTER MEANS AND METHOD FOR A POP-UP TYPE DISPENSING PACKAGE FOR INTERLEAVED PRE-MOISTENED SHEETS, teaches a starter sheet now abandoned in favor of continuation application Ser. No. 951,328, filed Oct. 16, 1978 in the name of the same inventors and under the same title, for a pop-up dispensing package of the type contemplated by the present application, but containing a stack of discrete, interleaved product sheets or a single, continuous, web of product sheets in roll form.

DISCLOSURE OF THE INVENTION

The present invention is directed to a starter sheet for a package of the type dispensing individual product sheets, one at a time in pop-up fashion and alternately from discrete first and second continuous webs of product sheets. The product sheets of each of the webs are defined by lines of perforations extending transversely of that web. The webs are located in face-to-face relationship with the lines of perforations of each of the webs being located midway between the lines of perforations of the other of the webs. The webs are interfolded to form a stack of products sheets wherein the product sheets of each web are folded at about their midpoints and are interleaved with product sheets of the other web with the first half of the first product sheet of the first web overlying the first half of the first product sheet of the second web at the top of the stack.

The package has a restrictive dispensing orifice of such size that the consumer cannot start the first product sheet of the first web through the dispensing orifice with his fingers.

The starter sheet of the present invention is formed into a Z-fold overlying and underlying the first half of the first product sheet of the first web and partially underlying the first half of the first product sheet of the second web. A portion of the starter sheet extends through the restrictive dispensing orifice of the package by an amount sufficient to be conveniently grasped by the fingers of the consumer.

The particular configuration and arrangement of the starter sheet of the present invention will assure that when the starter sheet is withdrawn from the package, the first product sheet of the first web will assume its proper pop-up position and the first product sheet of the second web will be brought to or slightly through the restrictive dispensing orifice.

DETAILED DESCRIPTION OF THE INVENTION

The starter sheet of the present invention is applicable to many types of containers for a stack of product sheets comprising two interfolded product sheet webs, the container having a dispensing orifice too small for the consumer to grasp the topmost product sheet through the dispensing orifice. As indicated above, for purposes of an exemplary showing the invention will be described in its application to a package for pre-moistened sheets, the package being of the type taught and illustrated in the above mentioned U.S. Pat. No. 4,138,034 and copending application Ser. No. 777,492.

The nature of the pre-moistened sheets to be dispensed does not constitute a limitation on the present invention. The sheets may be made of paper, nonwoven cloth, woven cloth, film or the like. The sheets may be pre-moistened with any appropriate volatile component. In recent years there has been increased interest in sheets, towelettes or tissues pre-moistened with a volatile component. The composition and purpose of the volatile component may vary widely. Non-limiting examples of such volatile components may include perfume, cleaning compound, wax, insecticide, insect repellent, topical medicaments and cosmetics.

The package may be made of rigid or semi-rigid plastic, paperboard laminates, combinations of paperboard and film or paperboard and rigid or semi-rigid plastics, or the like. The material from which the package is made will depend upon the nature of the volatile component with which the sheets are premoistened and should be compatible therewith and impervious thereto.

Figure 1:
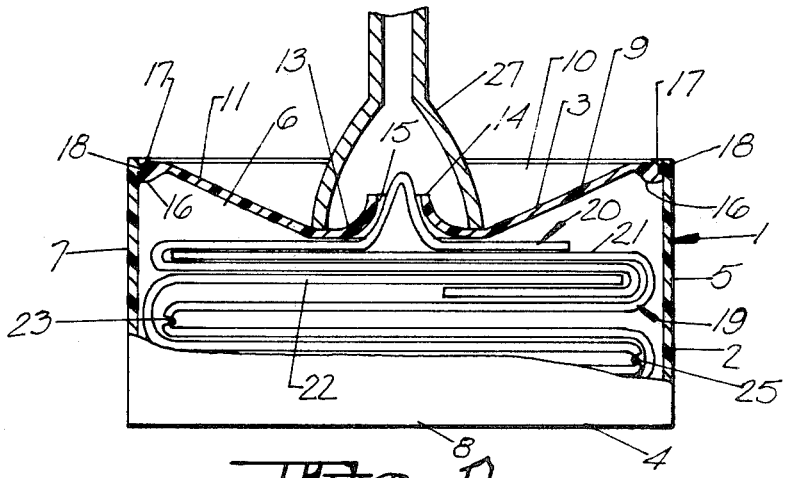
FIG. 1 is an elevational view, partly in cross section, of an exemplary package containing a stack of pre-moistened product sheets in the form of an interfolded pair of product sheet webs provided with the starter sheet of the present invention and further illustrates the starter sheet being drawn through the package dispensing orifice by a vacuum means.

An exemplary package is illustrated in FIG. 1. The package is generally indicated at 1 and comprises a rectangular tray and a cover member 3. The tray 2 has a bottom 4 and four substantially vertical sides 5, 6, 7 and 8 (see also FIG. 3). The cover member 3 is rectangular and has portions 9 through 12 which slope downwardly and inwardly from its four sides. The portions 9 through 12 terminate in a substantially flat, horizontal portion 13. At the center of horizontal portion 13 the top slopes upwardly, terminating in a substantially cylindrical portion 14 defining a dispensing orifice 15.

Once a stack of product sheets is located in tray 2, the cover member 3 will be affixed to the tray 2 the cover member 3 is not intended to be removed from tray 2 by the consumer, thereby eliminating the risk of contamination of the contents, spilling the product sheets or disturbing that arrangement of the product sheets which results in their pop-up dispensing. The manner in which cover member 3 is affixed to tray 2 does not constitute a limitation on the present invention. For purposes of an exemplary showing, the peripheral edges of the cover member 3 are illustrated as being enlarged, as at 16. The enlarged edges are provided with notches 17. The notches 17 are adapted to receive cooperating longitudinally extending lugs 18 formed on the inside surface of sides 5 through 8, near the top edges thereof. It is within the scope of the invention to affix cover member 3 to tray 2 mechanically, adhesively or by heat sealing, depending in part upon the materials from which the tray 2 and cover member 3 are made.

Dispensing orifice 15 may be of any appropriate configuration, although it is preferred that it be circular, as illustrated. As is taught in the above mentioned U.S. Pat. No. 4,138,034 the size of the dispensing orifice 15 is critical. In the practice of the present invention the orifice should be so sized as to permit twice the cross sectional area of a pre-moistened product sheet and the cross sectional area of the starter sheet (i.e. two pre-moistened product sheets and the starter sheet in tightly gather form) to pass therethrough. It will be understood that this refers to the cross sectional area of the starter sheet being extracted from the package, the first product sheet being pulled to pop-up position and the next succeeding product sheet being pulled to or slightly through the dispensing orifice. The dispensing orifice 15 should be so sized that the force required to pull a tightly gathered double thickness of the product sheets and the starter sheet therethrough is not so great as to be inconvenient to the consumer. Thus, the orifice size will be selected to achieve maximum restriction and still maintain easy dispensing, depending upon the orifice wall texture, the texture of the pre-moistened product sheets and the lubricating properties of the volatile compound with which the product sheets are pre-moistened. It will be evident from the above that the orifice 15 will be of such a size that the consumer could not pull the topmost product sheet therethrough with his fingers.

In the use of such a package, when a given product sheet is extracted from dispensing orifice 15, a sufficient amount of the next succeeding product sheet will be drawn through the orifice so that it may conveniently be grasped and extracted by the consumer at a later time. Thus, the orifice 15 permits pop-up dispensing of the product sheets. In addition, that portion of each product sheet which is pulled through the orifice 15 in gathered form by the previously extracted product sheet will serve as a plug for the orifice 15, minimizing dry-out and/or contamination of the remainder of the product sheets within the tray 2 without necessitating an additional resealable flap, hinged cover or plug-type closure for the package, as has hitherto been employed in prior art packages containing pre-moistened sheets. Thus, the package 1 provides a means for reliably dispensing individual wet product sheets while protecting the reserve product sheets from evaporation of the volatile composition with which they have been pre-moistened.

Heretofore, in dispensing packages having small dispensing orifices, it was common practice in the prior art to provide the package with a primary top containing the dispensing orifice and a secondary reclosable lid for the dispensing orifice. The consumer was required to remove the primary top and thread the topmost portion of the product through the small dispensing orifice, replacing the primary lid or top on the package. This approach has a number of disadvantages. First of all, it is inconvenient for the consumer. It also involves, as indicated above, the risk of contaminating the package contents and, when the contents constitute product sheets, there is also the risk of spilling the product sheets or disturbing their arrangement which enables their pop-up dispensing.

The above mentioned copending application Ser. No. 780,697 teaches the provision of a starter sheet for a package of the type illustrated in FIG. 1 provided with a stack of individual, discrete, interleaved, pre-moistened product sheets. Briefly, the starter sheet of the last mentioned copending application comprises a sheet less porous than the product sheets. The starter sheet is simply interleaved with the topmost product sheet of the stack. The starter sheet may thereafter be drawn through the restrictive dispensing orifice by vacuum so as to extend through the dispensing orifice by an amount sufficient to enable the starter sheet to be readily grasped by the consumer. It has been found, however, that such a starter sheet is subject to slippage and failure when applied to a stack of pre-moistened product sheets of the type to which the present application is directed.

Figure 2:
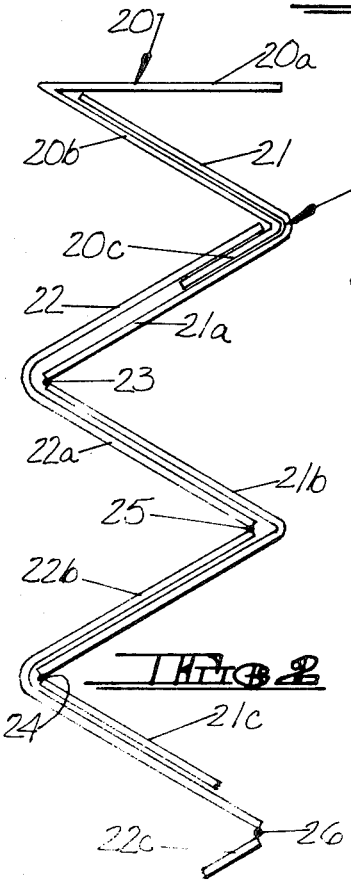
FIG. 2 is a fragmentary, semi-diagrammatic representation of the stack of product sheets provided with the starter sheet of the present invention.

FIG. 2 is a fragmentary, semi-diagrammatic view of a stack of pre-moistened sheets of the type to which the present invention is directed, provided with the starter sheet of the present invention. The stack of product sheets is generally indicated at 19 and the starter sheet is generally indicated at 20. It will be understood that the stack of sheets 19 and the starter sheet 20 have been extended or partially unfolded in a vertical direction to better illustrate the arrangement of the stack. It will also be understood that the thickness of the individual product sheets and the starter sheet have been greatly exaggerated for purposes of clarity.

The stack 19 of product sheets comprises first and second discrete, continuous webs 21 and 22 of product sheets. That much of web 21 which is illustrated in FIG. 2 is shown as comprising three identical product sheets **21*a*, 21*b* and 21*c*, defined by lines of perforations extending transversely of the web 21 and diagrammatically indicated at 23 and 24. That much of web 22 which is shown in FIG. 2 is illustrated as comprising three identical product sheets 22*a*, 22*b* and 22*c*, as defined by transverse lines of perforations diagrammatically indicated at 25 and 26. All of product sheets 21*a* through 21*c* and 22*a* through 22*c*** are preferably identical in length and width.

It will be noted that webs 21 and 22 are arranged in face-to-face relationship with the transverse lines of perforations 23 and 24 of web 21 falling at about the midpoints of product sheets **22*a* and 22*b* of web 22. Similarly, the transverse lines of perforations 25 and 26 of web 22 are located at about the midpoints of product sheets 21*b* and 21*c* of web 21. Thus, webs 21 and 22 are staggered with respect to each other by approximately one-half the length of a product sheet. It will be noted that the uppermost end of product sheet 22*a* of web 22 falls at about the midpoint of the first product sheet 21*a* of web 21**.

It will be evident from FIG. 2 that this arrangement will result in the fact that as the first product sheet **21*a* of first web 21 is drawn through dispensing orifice 15, the first product sheet 22*a* of web 22 will achieve pop-up position. When product sheet 22*a* of web 22 is withdrawn through dispensing orifice 15, the second product sheet 21*b* of web 21 will be brought to its proper pop-up position. Thus, as the product sheets are dispensed from the orifice 15 of package 1, they will be derived alternately from webs 21 and 22. It will be understood by one skilled in the art that the arrangement of product sheets of webs 21 and 22 will be repeated throughout the length of these webs and the length of webs 21 and 22 will depend upon the size of package 1** and the number of product sheets desired to be contained therein.

The starter sheet 20 of the present invention is a non-product sheet. As is clearly shown in FIG. 2, the starter sheet 20 is folded so as to form a Z-configuration made up of three portions **20*a*, 20*b* and 20*c*. The starter sheet 20 is interfolded with webs 21 and 22 in such a way that starter sheet portion 20*a* is substantially coextensive with and overlies the first half of the first product sheet 21*a* of web 21. The intermediate starter sheet portion 20*b* is of about the same length as starter sheet portion 20*a* and underlies the first half of first product sheet 21*a* of web 21 and overlies the first half of the first product sheet 22*a* of web 22. The third portion 20*c* of the starter sheet underlies a portion of the first half of first product sheet 22*a* of web 22 and overlies an equivalent portion of the second half of first product sheet 21*a* of web 21. Thus, the portions 20*a* and 20*b* of starter sheet 20 are equivalent in length to the length of a product sheet. It has been determined that the third starter sheet portion 20*c* should be of a length falling within the range of from about 15% to about 25% of the length of a product sheet. Thus, starter sheet 20 will have a length of from about 15% to about 25% greater than the length of a product sheet. The starter sheet 20** may have a width approximately equal to the width of the product sheets.

FIG. 1 illustrates the package 1 containing the stack 19 of product sheets and starter sheet 20. While starter sheet 20 may be extended partway through dispensing orifice 15 by mandrel means during the packaging process, it is preferred that this be done by vacuum means as shown in FIG. 1.

A vacuum head 27 of any appropriate and well known type is placed in contact with the cover member 3, as shown in FIG. 1. This may be done before or after the sealing of the cover member 3 to the tray 2. It will be understood that the vacuum head is connected to a source of vacuum (not shown). The vacuum head should be at least large enough to surround and encompass dispensing orifice 15. For purposes of an exemplary showing, the vacuum head 27 is illustrated as having a diameter sufficient to surround dispensing orifice 15 and engage cover member 3 at its substantially horizontal portion 13. A vacuum is in this fashion applied to dispensing orifice 15, drawing a portion of starter sheet 20 upwardly through the dispensing orifice. In FIG. 1, starter sheet 20 is illustrated just as it is beginning to be drawn through dispensing orifice 15.

The starter sheet 20 should be less porous than the product sheets so that when a vacuum is applied to the dispensing orifice 15, only the starter sheet is drawn therethrough. If the starter sheet is of the same porosity as the product sheets, the first one or more of the product sheets may also be drawn upwardly by the vacuum, preventing the starter sheet from being drawn through the restrictive dispensing orifice 15. While not required, the starter sheet may indeed be non-porous. The starter sheet may be made of any appropriate material such as plastic, cloth or paper which is either inherently less porous than the product sheets, or is treated to be so. The starter sheet must be compatible with the volatile component with which the product sheets are pre-moistened and must be sufficently strong and flexible to enable it to be drawn through the restrictive dispensing orifice 15. It is preferable that the inside surface of cover member 3 be slightly roughened or that the starter sheet be textured (either inherently or as by creping, embossing or the like) to assure that the starter sheet 20 does not stick to the inside surface of cover member 3 when a vacuum is applied.

Figure 3:
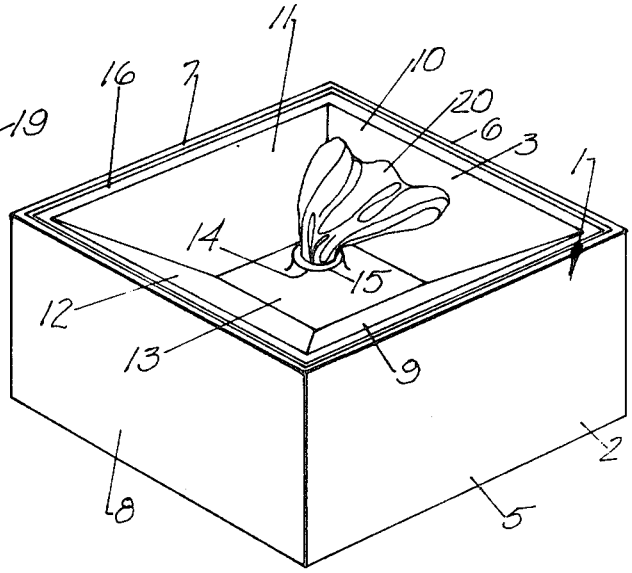
FIG. 3 is a perspective view of the package of FIG. 1, illustrating the starter sheet in position to be grasped by the consumer.

FIG. 3 illustrates the starter sheet 20 partially drawn through restrictive dispensing orifice. The starter sheet need only be drawn through the dispensing orifice 15 by an amount sufficient to enable the starter sheet to be grasped by the consumer. While this amount may be readily varied, in general, it has been found that if the starter sheet protrudes through dispensing orifice 7 by from about one-quarter to about three-quarters of an inch, the starter sheet may be easily removed by the consumer.

The operation of the package 1 and starter sheet 20 may now be described. Preferably, the package 1 will be provided with a detachable and discardable barrier layer or seal adhesively or otherwise affixed to cover member 3 and overlying dispensing orifice 15 and that portion of starter sheet 20 extending therethrough. Such a barrier layer or seal (not shown) is described in the above mentioned U.S. Pat. No. 4,138,034. The package 1 may also be provided with a partial or complete overwrap, or the package itself may be located within an outer carton such as a full flap paperboard carton or the like. These elements, of course, do not constitute a part of the present invention.

Figure 4:
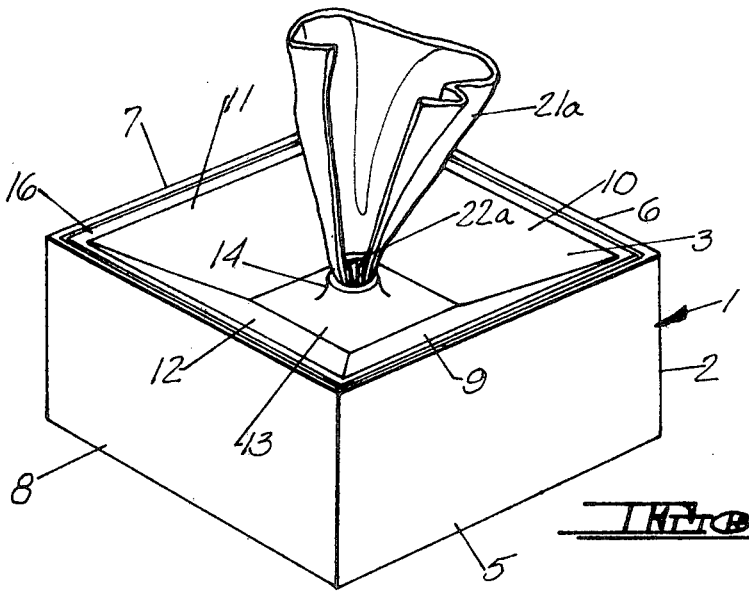
FIG. 4 is a perspective view similar to FIG. 3 and illustrating the first product sheet in its pop-up position after removal of the starter sheet.

Once the removable barrier layer or seal (if provided) has been removed by the consumer, he will be presented with the starter sheet in the position illustrated in FIG. 3. The consumer need only remove starter sheet 20 from the package 1. The particular configuration of starter sheet 20, and in particular the provision of the additional starter sheet portion or length **20*c* will accomplish two purposes. First of all, it will assure that the first product sheet 21*a* of web 21 will be brought to its pop-up position wherein approximately half the length of product sheet 21*a* will extend through restrictive dispensing orifice 15. This is illustrated in FIG. 4, wherein like parts have been given like index numerals. Simultaneously, the additional portion 20*c* of starter sheet 20 will cause the first product sheet 22*a* of web 22 to be brought to or partially through the restrictive dispensing orifice 15 (again as is shown in FIG. 4). As a result, the double-web stack 19 of product sheets will be properly started by starter sheet 20 assuring proper one at a time dispensing of the product sheets of webs 21 and 22**.

The choice of an appropriate starter sheet 20 is well within the skill of the worker in the art. It will be understood that if the starter sheet 20 is too stiff or thick, it will not properly draw through dispensing orifice 15. On the other hand, if starter sheet 15 is too thin, it may be ruptured by the vacuum or it may fail to pull the first product sheet **21*a* of web 21** through dispensing orifice.

As a nonlimiting example, excellent results were achieved with a package of the type illustrated in FIG. 1 wherein the cover 3 had a circular dispensing orifice 15 with a ¼ inch diameter (i.e. an opening area of 0.0491 square inch). The product sheets were of nonwoven rayon 2.5 inches wide and 0.005 inch thick (i.e. a cross sectional area of 0.0125 square inch, two sheets having a total cross sectional area of 0.025 square inch). The product sheets were 5 inches long and the volatile component with which the sheets were pre-moistened was a light oil. The product sheets were extracted through the dispensing orifice 15 in the cross machine direction of the sheets. In this example, a polyvinyldichloride starter sheet was used. The starter sheet was 2.5 inches wide, 6 inches long and had a thickness of 1 mil. The starter sheet was drawn partway through the dispensing orifice by a vacuum at a pressure of 20 inches of mercury. It will be evident from the above that the additional length of the starter sheet (i.e. the portion **20*c***) was 20% of the length of the product sheets. Performance of the starter sheet was excellent.

While the teachings of the present invention are directed to a package having a restrictive dispensing orifice as defined above, the orifice need not be of the specific type illustrated in FIG. 1. Furthermore, the teachings of the present invention are not limited to product sheets which have been pre-moistened with a volatile component.

Figure 5:
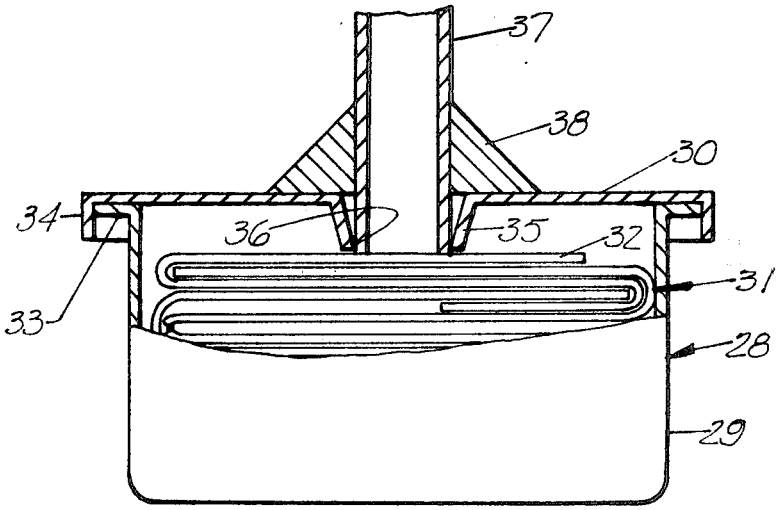
FIG. 5 is a fragmentary elevational view, partly in cross section, similar to FIG. 1 and illustrating another embodiment of package to which the present invention may be directed.

Reference is now made to FIG. 5 wherein another embodiment of the present invention is illustrated. In FIG. 5 a package is generally indicated at 28. The package comprises a tray-like portion 29 and a cover 30. The package is again intended to dispense product sheets in a pop-up manner and is provided with a stack 31 of sheets identical to the stack 19 of sheets described with respect to FIGS. 1 and 2. The stack 31 of sheets is provided with a starter sheet 32 identical to starter sheet 20 of FIGS. 1 through 3.

In the embodiment of FIG. 5 the tray 29 has about its upper edge a laterally extending peripheral flange 33. The cover 30 is provided with a downwardly depending peripheral flange 34 and is so sized as to just nicely receive the flange 33 of tray 29. Once the sheets stack 31 has been located within the tray 29, the cover member 30 may be located thereon and heat sealed or adhesively affixed thereto, depending upon the nature of the material from which the tray 29 and cover member 30 are made.

The nature of the dispensing orifice is not limiting other than it is of such size that the consumer cannot conveniently start the topmost product sheet through the dispensing orifice with his finger. In the embodiment of FIG. 5, the cover member 30 is illustrated as having a downwardly and inwardly sloping portion 35 defining a circular dispensing orifice 36.

It will be understood that the starter sheet 32 will serve exactly the same function as starter sheet 20 of FIGS. 1 through 3 and will do so in exactly the same manner. For purposes of an exemplary showing, the embodiment of FIG. 5 illustrates a vacuum head or tube 37 so sized that it may extend through the restrictive dispensing orifice 36 with its end located near or in contact with starter sheet 32. The vacuum head or tube 37 may be provided with stop means 38 to limit the depth to which it extends into the package 28 through the dispensing orifice 36. Upon the application of a vacuum, the starter sheet will be held in contact with the vacuum tube 37 and drawn through the dispensing orifice 36 by retraction of the vacuum tube.

It will be understood by one skilled in the art that a vacuum tube of the type shown at 37 in FIG. 5 could be used with a package of the type illustrated at 1 in FIG. 1. It would be within the scope of the invention to provide starter sheets 20 or 32 with printed indicia such as advertising, a marketing message or the like. Although the invention has been described in terms of the starter sheet being withdrawn through the dispensing orifice by the consumer, it is also within the scope of the present invention to have the starter sheet withdrawn as a part of the packaging process, so that the consumer is presented with the topmost product sheet in its pop-up position.

Modifications may be made in the invention without departing from the spirit of it. For example, the length of the portion 20*c* of the starter sheet 20 required may vary depending upon the nature of the starter sheet, the nature of the product sheets, the nature of the volatile composition (if used), the nature of the dispensing orifice and the desired performance of the starter sheet. For instance, the portion 20*c* of the starter sheet 20 could have a length up to about 50% of the product sheet length. Under these circumstances and if no slippage occurs, removal of the starter sheet 20 would result in complete removal of first product sheet 21*a* and the shifting of second product sheet 22*a* to its pop-up position.

What we claim is:

1. In a package of the type dispensing individual product sheets one at a time in pop-up fashion alternately from discrete, first and second continuous webs of product sheets, said product sheets of each of said webs being defined by lines of perforations extending transversely of said web, said webs being located in face-to-face relationship with said lines of perforations of each of said webs being located midway between said lines of perforations of the other of said webs, said webs also being interfolded to form a stack of product sheets wherein said product sheets of each of said webs are folded at about their midpoints and are interleaved with said product sheets of the other of said webs with the first half of the first of said product sheets of said first web overlying the first half of the first of said product sheets of said second web at the top of said stack, said package comprising a tray portion to receive said stack of product sheets and a cover member for said tray portion to close said tray portion, said cover member having a restrictive dispensing orifice of such size that the consumer could not start said first product sheet of said first web through said dispensing orifice with his fingers, the improvement comprising a starter sheet, said starter sheet being formed into a Z-fold overlying and underlying said first half of said first product sheet of said first web and partially underlying said first half of said first product sheet of said second web, said cover member overlying said starter sheet, a portion of said starter sheet extending through said restrictive dispensing orifice, said last mentioned portion of said starter sheet being of sufficient length as to be conveniently grasped by the fingers of said consumer.

2. The structure claimed in claim 1 wherein all of said product sheets are identical in dimensions, said starter sheet having the same width as said product sheets and being of a length up to about 50% longer than said product sheets, said additional starter sheet length constituting said portion of said starter sheet underlying said second product sheet.

3. The structure claimed in claim 1 wherein all of said product sheets are identical in dimensions, said starter sheet having the same width as said product sheets and being from about 15% to about 25% longer than said product sheets, said additional length of said starter sheet constituting said portion thereof underlying said second product sheet.

4. The structure claimed in claim 1 wherein said product sheets are pre-moistened with a volatile component.

5. The structure claimed in claim 1 wherein said starter sheet is less porous than said product sheet.

6. The structure claimed in claim 1 wherein said starter sheet comprises a polyvinyldichloride sheet.

7. The structure claimed in claim 1 wherein said starter sheet is of such strength and flexibility that said length thereof extending through said restrictive orifice can be drawn therethrough by vacuum.

8. The structure claimed in claim 4 wherein said restrictive dispensing orifice is so dimensioned as to just permit two of said pre-moistened sheets and said starter sheet in tightly gathered form to be manually drawn therethrough.

9. The structure claimed in claim 7 wherein said starter sheet is non-porous.

* * * * *